US005977945A

United States Patent [19]

Ohshima

[11] Patent Number: 5,977,945

[45] Date of Patent: Nov. 2, 1999

[54] DISPLAY CONTROL APPARATUS

[75] Inventor: Masamichi Ohshima, Tokyo, Japan

[73] Assignee: Canon Kabushiki Kaisha, Tokyo, Japan

[21] Appl. No.: 08/936,997

[22] Filed: Sep. 25, 1997

Related U.S. Application Data

[63] Continuation of application No. 08/680,974, Jul. 16, 1996, abandoned, which is a continuation of application No. 08/330,601, Oct. 20, 1994, abandoned, which is a continuation of application No. 07/945,399, Sep. 16, 1992, abandoned.

[30] Foreign Application Priority Data

Sep. 18, 1991 [JP] Japan ..... 3-265444

[51] Int. Cl.[6] ..... G09G 3/36

[52] U.S. Cl. ..... 345/100; 345/516; 345/97

[58] Field of Search ..... 345/87, 97, 98, 345/99, 100, 55, 507, 515, 516; 348/792, 793

[56] References Cited

U.S. PATENT DOCUMENTS 4,414,628 11/1983 Ahuja ..... 345/120
4,655,561 4/1987 Kanbe et al. ..... 359/56
4,693,563 9/1987 Harada ..... 359/56
5,058,994 10/1991 Mihara et al. ..... 359/56
5,091,723 2/1992 Kanno et al. ..... 340/784

FOREIGN PATENT DOCUMENTS 0368117 5/1990 European Pat. Off. .
0416172 3/1991 European Pat. Off. .

*Primary Examiner*—Dennis-Doon Chow
*Attorney, Agent, or Firm*—Fitzpatrick, Cella, Harper & Scinto

[57] ABSTRACT

A display control apparatus includes display device driver means for writing image information into a frame buffer, and display scanning means for sequentially displaying the image data stored in the frame buffer for each line of the display. The display control apparatus further includes partially rewritten line determination means for obtaining from the display device driver means information regarding lines to be written into the frame buffer, and generating in accordance therewith the lines for which the display is to be scanned, and display scan line control means for obtaining from the partially rewritten line determination means lines to be scanned to specify such lines for the display scanning means.

7 Claims, 4 Drawing Sheets

15
FLC DISPLAY
27
GRAPHIC CONTROLLER
28
LOCAL MEMORY
13
FRAME BUFFER
GRAPHIC SUBSYSTEM
26
SBus
22
SBus CONTROLLER
23
MAIN MEMORY
24
HARD DISK
25
KEY BOARD
HOST SYSTEM
21
CPU

DISPLAY CONTROL APPARATUS

This application is a continuation, of application Ser. No. 08/680,974 filed Jul. 16, 1996, now abandoned, which is a continuation of application Ser. No. 08/330,601 filed Oct. 20, 1994, now abandoned, which is a continuation of application Ser. No. 07/945,399 filed Sep. 16, 1992, now abandoned.

BACKGROUND OF THE INVENTION

1. Field of the Invention

The present invention relates to a raster scan display control apparatus. More particularly, the invention relates to such a display control apparatus for a display using a ferroelectric liquid crystal (FLC).

2. Related Background Art

Hitherto, in a raster scanning display control apparatus, the structure has been arranged to sequentially display image information, accumulated in a frame buffer, per line while keeping constant the displaying cycle for each of the scanning lines and the displaying cycle for one frame as well. Furthermore, if the frame frequency cannot be made high due to the material properties or electrical restraints of a display device, so-called interlace method is adopted to prevent flickers (screen flickering).

In a display device using a ferroelectric liquid crystal, particularly in case of a device having many numbers of lines, the use of a high order interlace (multi-interlacing) is imperative in order to prevent flickers.

However, if a display is performed by the use of the multi-interlacing, the object which is reproduced on a screen (for example, cursor, characters, icon, other graphics, or the like) is accompanied by so-called "barake" or dispersion when it is shifted or newly reproduced; hence spoiling the quality of display significantly. Particularly, a mouse cursor is directly operated by the user and its operational frequency is also high. Therefore, the dispersion attributable to the use of the mouse cursor may spoil the operational sensitivity of the entire system.

As means to prevent the dispersion of an object on a screen when multi-interlacing is applied, there is a method called "partial rewriting" such as proposed by Kanbe et al. (U.S. Pat. No. 4,655,561). This method is such that in shifting an object on a screen or reproducing it thereon, only the line area where the screen representation changes is temporarily displayed by non-interlacing method. There is also a method to implement this partial rewriting by means of software such as proposed by Inoue et al. (U.S. Pat. No. 5,058,994, U.S. Pat. No. 5,091,723, and others). However, no proposal has ever been made to regulate any particular means to be incorporated in the entire structure of a display control apparatus.

SUMMARY OF THE INVENTION

The present invention is designed in consideration of the problems encountered in the above-mentioned conventional examples, and an object of the invention is to provide specific means or structure to implement the foregoing partial writing method.

According to the present invention, there is provided a display control apparatus having display device driver means for writing image information into a frame buffer, and display scanning means for sequentially displaying the image data stored in the frame buffer by each line of the display, which comprises:

partially written line determination means for obtaining information regarding line to be written into the frame buffer from the display device driver means to generate in accordance with the information the lines for which the display must be scanned; and display scan line control means for obtaining from the partially written line determination means the lines for which the display must be scanned to specify such lines for the display scanning means.

Hence, a method is made clear to structure the partial writing method in a display control apparatus.

DETAILED DESCRIPTION OF THE PREFERRED EMBODIMENTS

Hereinafter, the description will be made of the embodiments according to the present invention using the accompanying drawings.

Figure 1:
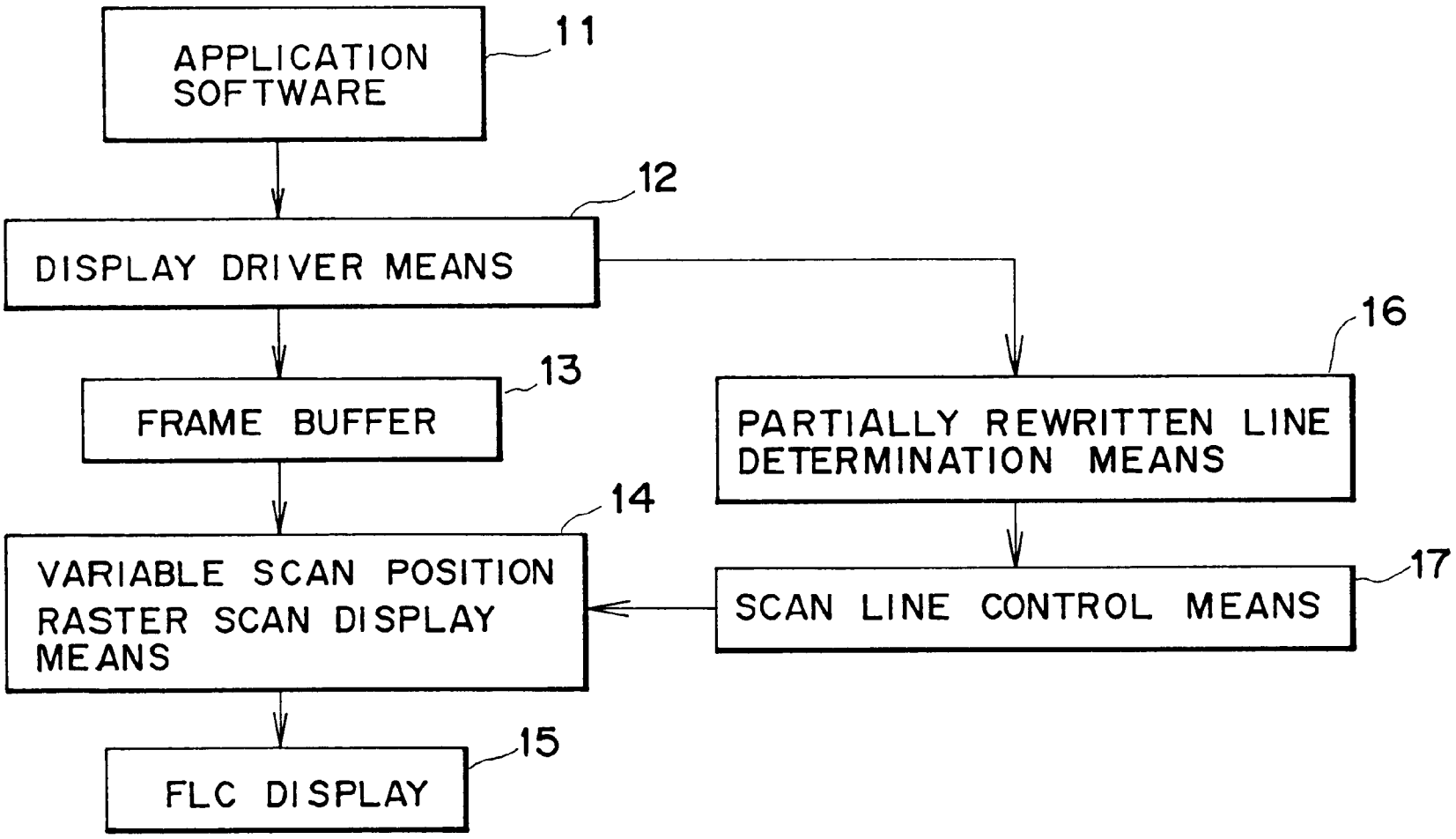
FIG. 1 is a functional block diagram corresponding to the Claims of the present invention.

FIG. 1 is a view showing the fundamental structure of a display control apparatus according to the present invention. In FIG. 1, display driver means 12 up-dates the image data in the frame buffer 13 as requested by application software 11 and at the same time, transfers the information regarding up-dated line to partially rewritten line determination means 16. The partially rewritten line determination means 16 determines the line for which partial rewriting must be executed on the basis of the information transferred from the display driver means 12, and then delivers the information to scan line control means 17. The scan line control means 17 specifies the scanning line transferred from the partially rewritten line determination means 16 for variable scan position raster scan display means 14. The variable scan position raster scan display means 14 transfers the data in the frame buffer corresponding to the line specified by the scan line control means 17 to an FLC display 15 for display. This variable scan position raster scan display means 14 transfers data corresponding to each line sequentially to the FLC display 15 for display from the image data in the frame buffer 13 in accordance with a given regulation unless any line to be scanned is specified by the scan line control means 17.

Figure 2:
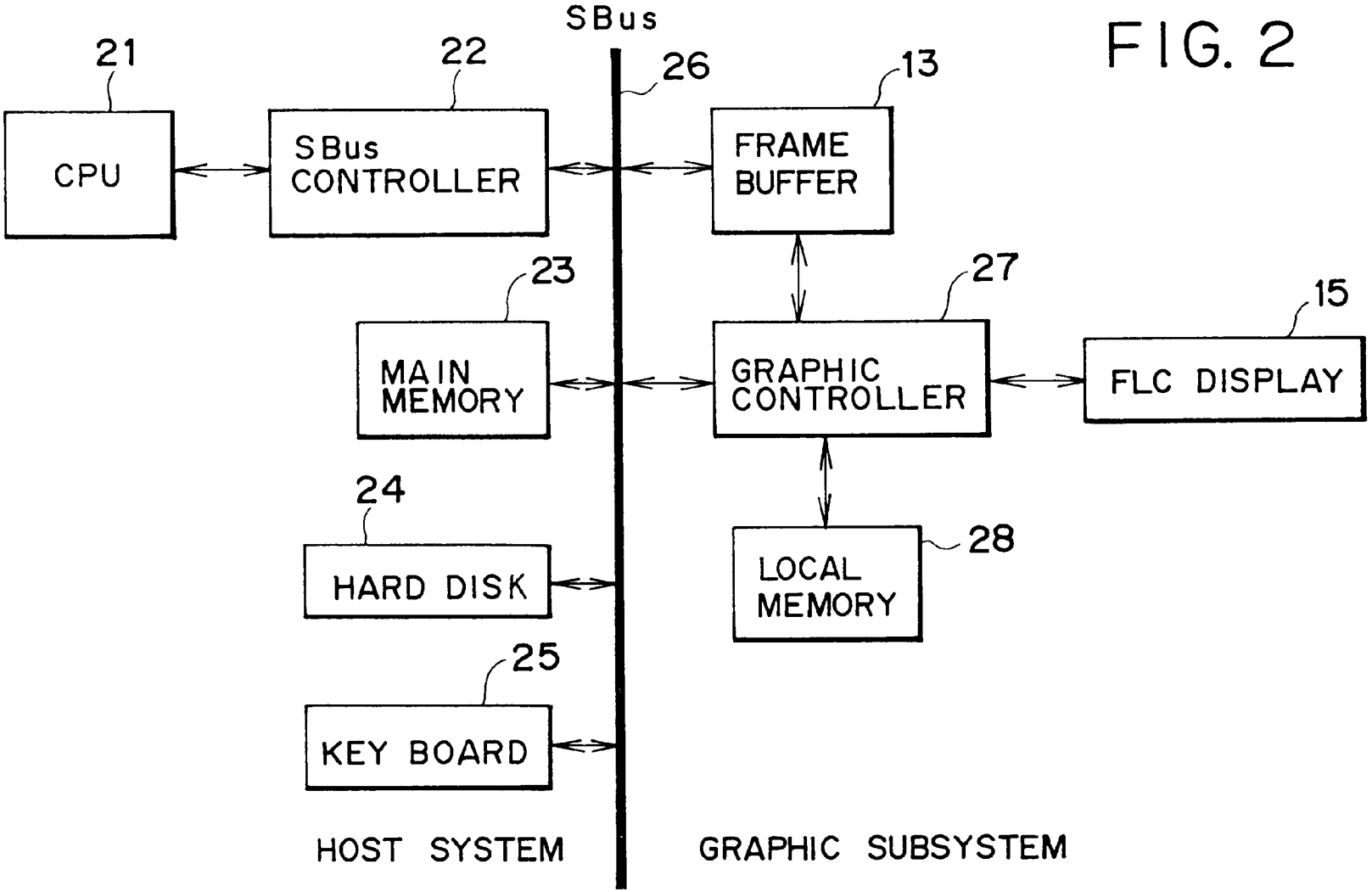
FIG. 2 is a view showing the structure of the entire hardware of an information display apparatus according to an embodiment of the present invention.
Figure 3:
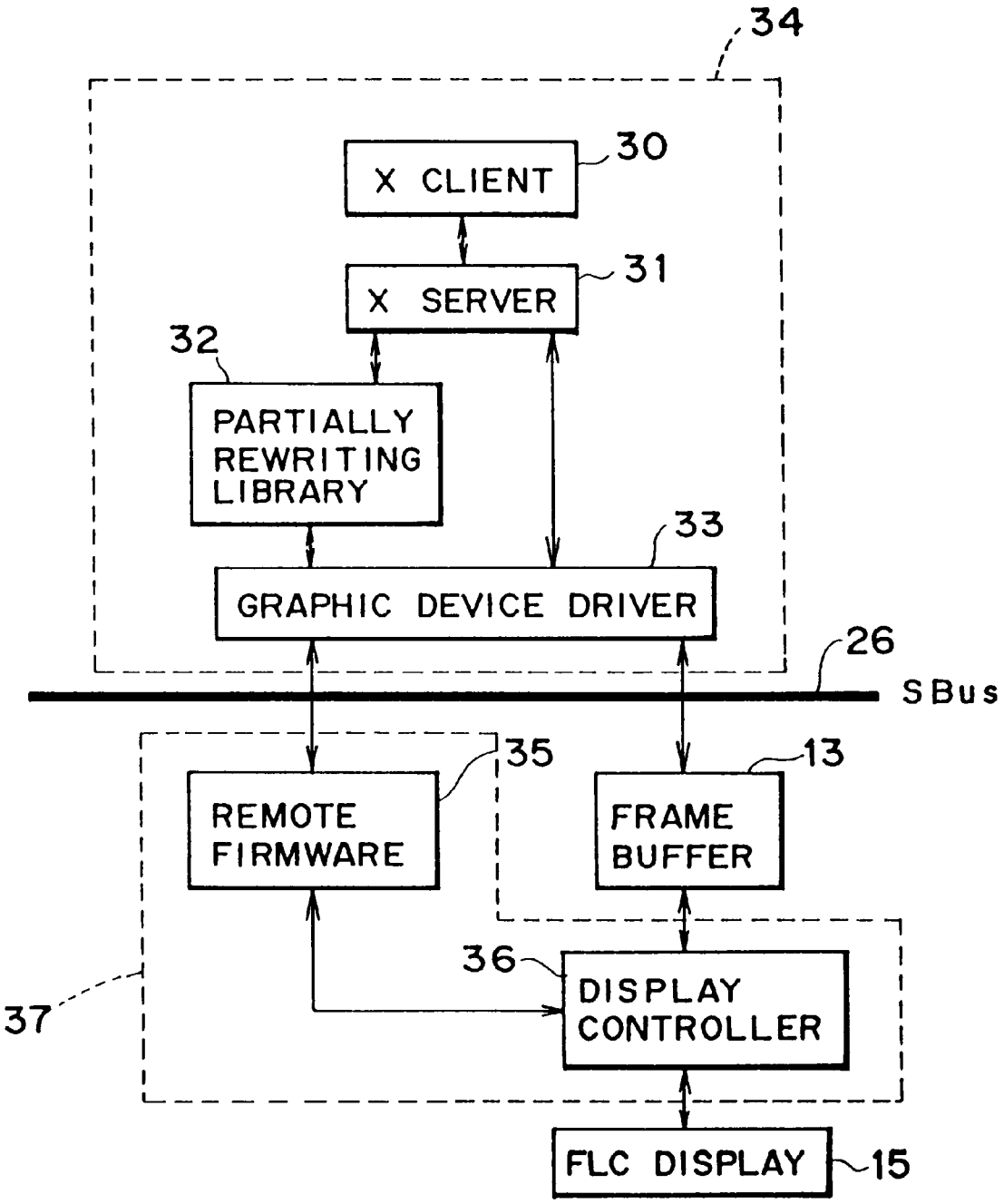
FIG. 3 is a view showing an embodiment of the respective functional blocks shown in FIG. 1 in conjunction with the structure of the hardware shown in FIG. 2.

Now, FIG. 2 will be explained. FIG. 2 is a view showing an example of the hardware structure to actually implement the partially rewritten line determination means 16 and scan line control means 17 shown in FIG. 1 by means of software. A central arithmetic processing unit (CPU) 21 executes software instructions issued by operational systems, application software, or the like. An SBus controller 22 (SBus–esbus—is a registered trade mark of Sun Microsystems Inc.) appropriately changes the addresses generated by the central arithmetic processing unit 21 to enable access to an objective device. A main memory 23 holds instruction codes and data for and from the operational systems, application software, or the like currently under execution. A hard disk 24 stores software and data as files. A keyboard 25 receives input from a system operator. The frame buffer 13 stores the image data for images to be displayed. A graphic controller 27 has functions to allow the image data stored in the frame buffer 13 to be displayed on the FLC display 15 (hereinafter referred to as FLCD). The graphic controller 27 is assumed to function dually for the execution of instruction codes held in a local memory 28. The local memory 28 holds the instructions and data to be executed by the graphic controller 27. Of those mentioned above, the central arithmetic processing unit 21, SBus controller 22, main memory 23, hard disk 24 and key board 25 constitute a host system 34 (FIG. 3) while the frame buffer 13, FLCD 15, graphic controller 27, and local memory 28 constitute graphic sub-system control module 37 (FIG. 3). The graphic sub-system 37 is connected to the host system 34 through the SBus 26.

Each means shown in FIG. 1 can be implemented in several forms as software executable on the hardware shown in FIG. 2. Here, two modes are represented as shown in FIG. 3 and FIG. 4.

In FIG. 3, an X client 30 (X or X Window System is a trade mark registered by Massachusetts Institute of Technology) functions in response to the application software 11 while an X server 31 issues image representation requests. The X server 31 functions in response to the display driver means 12 to write image data into the frame buffer 13 using the functions of a graphic device driver 33. Likewise, a partial rewriting library 32 functions in response to the partially rewritten line determination means 16 and remote firmware 35, to the scan line control means 17. The partial rewriting library 32 obtains information regarding the image representation area from the X server 31 to determine the line to which partial writing should be applied and transfers such information to the remote firmware 35 using the function of the graphic device driver 33. The remote firmware 35 specifies the scanning line for the display controller 36 on the basis of this information. The X client 30, X server 31, partial rewriting library 32, and graphic driver 33 are the software executed by the central arithmetic processing unit 21 in FIG. 2. On the other hand, the remote firmware 35 is a software executed by the graphic controller 28. The display controller 36 can be implemented with the functions provided by the graphic controller 27 as hardware. As a graphic controller provided with such a function as this, TMS34020 (Registered Trade Mark: Texas Instruments Inc.) or the like can be named, for example.

Figure 4:
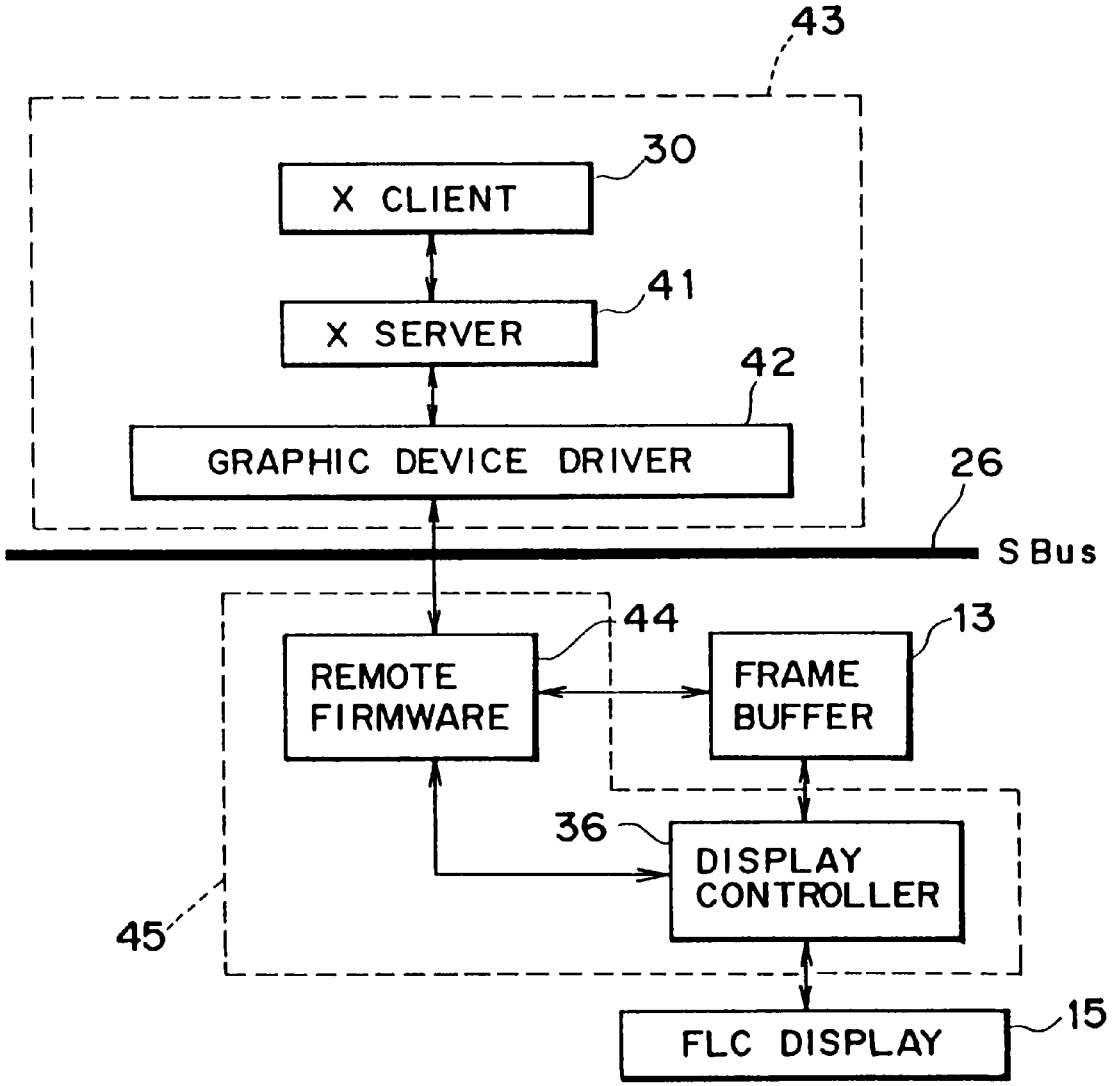
FIG. 4 is a view showing another embodiment of the respective functional blocks shown in FIG. 1 in conjunction with the structure of the hardware shown in FIG. 2.

FIG. 4 shows an embodiment different from the one shown in FIG. 3. In FIG. 4, a central arithmetic processing unit 21, SBus controller 22, main memory 23, hard disk 24 and key board 25 constitute a host system 43. On the other hand, a frame buffer 13, FLCD 15, graphic controller 27 and local memory 28 constitute a graphic sub-system control module 45. The graphic sub-system 45 is connected to the host system 43 by means of the SBus 26. An X server 41 issues image representation commands to a remote firmware 44 using the functions of a graphic device driver 42. Here, the image representation commands are composed of instruction codes such as line plotting and area painting, and its factors. The remote firmware 44 interprets such image representation commands to write image data into the frame buffer 13. At the same time the remote firmware 44 determines the line to which partial rewriting should be applied among the lines having the image data thus written, and specifies such a line for the display controller 36. Here, the remote firmware 44 is software executed by the graphic controller 27 shown in FIG. 2 while the display controller 36 can be implemented by the functions provided for the graphic controller 27 shown in FIG. 2 as in the case described in conjunction with FIG. 3. However, in FIG. 4, the remote firmware 44 functions as both means of partially rewritten line determination means 16 and scan line control means 17 shown in FIG. 1.

In the present invention, as represented by the embodiments shown in FIG. 3 and FIG. 4, there is no particular requirement as to the location where the partially rewritten line determination means 16 and scan line control means 17 are executed as software in the systems (whether on the host system side or the graphic sub-system side). Also, both means 16, 17 may be realized by one software module.

As described above, a process routine for determining a partial rewriting line is incorporated in a process routine with which to write into the frame buffer, and then further with this routine, the display scanning lines are actually controlled; thus making it possible to apply to an actual display control apparatus the partial rewriting method for which no structural methods have ever been disclosed.

Also, with the above-mentioned structure, when an object to be represented on a display is generated or shifted, the display device driver means can rewrite only the image information in a portion in the frame buffer, which is changed due to the generation or shifting of such an object. The partially rewritten line determination means can also generate the lines for which the display should be scanned on the basis of the information regarding the lines to be written into the frame buffer, which is obtained from display device driver means. Also, the display scan line control means can obtain the scanning line from the partially rewritten line determination means to specify such lines for the display scanning means. The display scanning means reads the image information of the scanning line from the frame buffer in accordance with the instruction from the display scan line control means so as to enable rewriting of the corresponding scanning line on the display. In this way, only the scanning lines including the image information which has been changed due to the generation or shifting of an object can be scanned, so that the object can be generated or shifted substantially in real time on the display.

Therefore, according to the present invention, the partial rewriting method, for which no structure has hitherto been disclosed, can applied to an actual display control apparatus as specific means or structure.

Although the present invention has been described with reference to the specific embodiments, it should be understood that various modifications and variations can be easily made by those skilled in the art without departing from the spirit of the invention. Accordingly, the foregoing disclosure should be interpreted as illustrative only and not to be interpreted in a limiting sense. The present invention is limited only by the scope of the following claims.

What is claimed is:

1. An apparatus for performing a raster scanning display operation on a display including a plurality of scanning lines, comprising:

storing means for storing image data to be displayed;

updating means, including a program, for performing an updating operation to update a portion of the image data stored in the storing means to different, updated image data, the updated image data being determined by said updating means using a command of the program; and drive means for driving the display to perform the display operation in accordance with the updated image data, wherein said updating means performs the updating operation without accessing the previously stored image data and simultaneously supplies line information designating one of the scanning lines on which to display the updated data to said drive means.

2. An apparatus according to claim 1, wherein said image data is generated in accordance with a command of application software.

3. A display apparatus according to claim 2, wherein the display is a ferroelectric liquid crystal display.

4. An apparatus according to claim 1, wherein said updating means executes processing for supplying said line information with software of a central arithmetic processing unit and of a graphic controller.

5. An apparatus according to claim 1, wherein said drive means sequentially selects a plurality of scanning lines of the display to perform the display operation.

6. A drive control apparatus for controlling driving of a display device provided with drive means for sequentially selecting a plurality of scanning lines of a display to perform a raster scanning display operation, said drive control apparatus comprising:

storing means for storing image data to be displayed; and updating means, including a program, for updating a portion of the image data stored in the storing means to different, updated image data, the updated image data being determined by said updating means using a command of the program, wherein said updating means includes means for performing an updating operation without accessing the previously stored image data and for simultaneously supplying line information designating one of the scanning lines on which to display the updated data to said drive means.

7. A display apparatus comprising:

a display including a plurality of scanning lines;

storing means for storing image data to be displayed;

drive means for sequentially selecting a scanning line of said display and for driving said display to perform a raster scanning display operation, in accordance with the image data stored in said storing means; and updating means, including a program, for performing an updating operation to update a portion of the image data stored in the storing means to different, updated image data, the updated image data being determined by said updating means using a command of the program;

wherein said updating means performs the updating operation without accessing the previously stored image data and simultaneously supplies line information designating one of the scanning lines on which to display the updated data to said drive means.

* * * * *

UNITED STATES PATENT AND TRADEMARK OFFICE

CERTIFICATE OF CORRECTION

PATENT NO. : 5,977,945

DATED : November 2, 1999

INVENTOR(S) : MASAMICHI OHSHIMA

It is certified that error appears in the above-identified patent and that said Letters Patent is hereby corrected as shown below:

COLUMN 1:

Line 35, "reproduced;" should read --reproduced,--; and
Line 47, "by" should read --by a--.

COLUMN 2:

Line 63, "trade mark" should read --trademark--.

COLUMN 3:

Line 12, "key board 25" should read --keyboard 25--;
Line 22, "trade mark" should read --trademark--;
Line 45, "Trade Mark:" should read --Trademark:--; and
Line 51, "key board 25" should read --keyboard 25--.

UNITED STATES PATENT AND TRADEMARK OFFICE

CERTIFICATE OF CORRECTION

PATENT NO. : 5,977,945

DATED : November 2, 1999

INVENTOR(S) : MASAMICHI OHSHIMA

It is certified that error appears in the above-identified patent and that said Letters Patent is hereby corrected as shown below:

COLUMN 4:

Line 44, "applied" should read --be applied--.

Signed and Sealed this

Third Day of April, 2001

Nicholas P. Godici

*Attest:*

NICHOLAS P. GODICI

*Attesting Officer*

*Acting Director of the United States Patent and Trademark Office*